US010981206B2

(12) United States Patent
Kerr et al.

(10) Patent No.: US 10,981,206 B2
(45) Date of Patent: Apr. 20, 2021

(54) PRECISION FORMING OF METALLIC HOLLOW EXTRUSIONS

(71) Applicants: CONSTELLIUM SINGEN GMBH, Singen (DE); CONSTELLIUM AUTOMOTIVE USA, LLC, Van Buren Township, MI (US)

(72) Inventors: Sean Kerr, West Bloomfield, MI (US); Alejandro F. Graf, Canton, MI (US)

(73) Assignees: CONSTELLIUM-SINGEN GMBH, Singen (DE); CONTELLIUM AUTOMOTIVE USA, LLC, Van Buren Township, MI (US)

( * ) Notice: Subject to any disclaimer, the term of this patent is extended or adjusted under 35 U.S.C. 154(b) by 88 days.

(21) Appl. No.: 15/569,469

(22) PCT Filed: Jun. 7, 2016

(86) PCT No.: PCT/EP2016/062892

§ 371 (c)(1),
(2) Date: Oct. 26, 2017

(87) PCT Pub. No.: WO2016/198396

PCT Pub. Date: Dec. 15, 2016

(65) Prior Publication Data

US 2018/0297098 A1 Oct. 18, 2018

Related U.S. Application Data

(60) Provisional application No. 62/172,324, filed on Jun. 8, 2015.

(51) Int. Cl.
*B21D 22/02* (2006.01)
*B21D 39/20* (2006.01)
(Continued)

(52) U.S. Cl.
CPC ..... *B21D 22/025* (2013.01); *B21D 39/20* (2013.01); *B21D 41/028* (2013.01); *B21D 53/88* (2013.01); *B21C 37/16* (2013.01)

(58) Field of Classification Search
CPC .... B21D 41/028; B21D 39/20; B21D 39/203; B21D 39/206; B21D 31/04; B21D 22/025; B21C 37/18
See application file for complete search history.

(56) References Cited

U.S. PATENT DOCUMENTS 3,581,548 A * 6/1971 Lilygren ..... B21D 22/025 138/154
5,557,961 A 9/1996 Ni et al.
(Continued)

FOREIGN PATENT DOCUMENTS

CN 201052535 Y 4/2008
CN 103192879 A 7/2013
(Continued)

OTHER PUBLICATIONS

International Report dated Sep. 7, 2016 for Application No. PCT/EP2016/062892.
(Continued)

*Primary Examiner* — Debra M Sullivan
(74) *Attorney, Agent, or Firm* — Ladas & Parry LLP; Malcolm J. MacDonald

(57) ABSTRACT

A method for manufacturing a high precision hollow metallic component, by obtaining, through extruding or roll forming, a precursor hollow metallic profile having a constant cross section and at least one precursor chamber; positioning the precursor hollow metallic profile in a split-die cavity, wherein at least two walls of said split die cavity have essentially outside dimensions of corresponding walls of the high-precision hollow metallic component; introducing a mandrel made of at least two parts into the precursor
(Continued)

chamber; plastically deforming the precursor hollow metallic profile by expanding the mandrel to obtain finished dimensions of the high-precision hollow metallic component; removing the mandrel from the finished chamber after reversing an expanding action. A variable cross section hollow metallic component, with at least two chambers obtained with the method, is also described.

18 Claims, 4 Drawing Sheets

(51) Int. Cl.

| | |
|---|---|
| ***B21D 41/02*** | (2006.01) |
| ***B21D 53/88*** | (2006.01) |
| *B21C 37/16* | (2006.01) |

(56) References Cited

U.S. PATENT DOCUMENTS

| | | | |
|---|---|---|---|
| 2009/0102234 | A1 | 4/2009 | Heatherington et al. |
| 2009/0305797 | A1 | 12/2009 | Brochheuser et al. |

FOREIGN PATENT DOCUMENTS

| | | | |
|---|---|---|---|
| DE | 10 2014 004 183 | A1 | 9/2014 |
| EP | 0 733 539 | A1 | 9/1996 |
| EP | 2 272 601 | A1 | 1/2011 |
| EP | 2 355 942 | B1 | 8/2011 |
| JP | 8-104253 | A | 4/1996 |
| JP | 9-122747 | A | 5/1997 |
| JP | 2010051977 | A | 3/2010 |
| WO | 03/084692 | A1 | 10/2003 |
| WO | 2012128733 | A1 | 9/2012 |

OTHER PUBLICATIONS

Patent Abstracts of Japan English abstract of JP 9-122747 A.
English translation of JP 9-122747 A.
Espacenet English abstract of DE 10 2014 004 183 A1.
Patent Abstracts of Japan English abstract of JP 8-104253 A.
Espacenet English abstract of EP 0 733 539 A1.
Espacenet English abstract of EP 2 355 942 B1.
Espacenet English abstract of EP 2 272 601 A1.
Non-English Chinese Office Action and Search Report, dated Nov. 20, 2018, corresponding to Chinese Application No. 2016800294021.

* cited by examiner

FIG 1
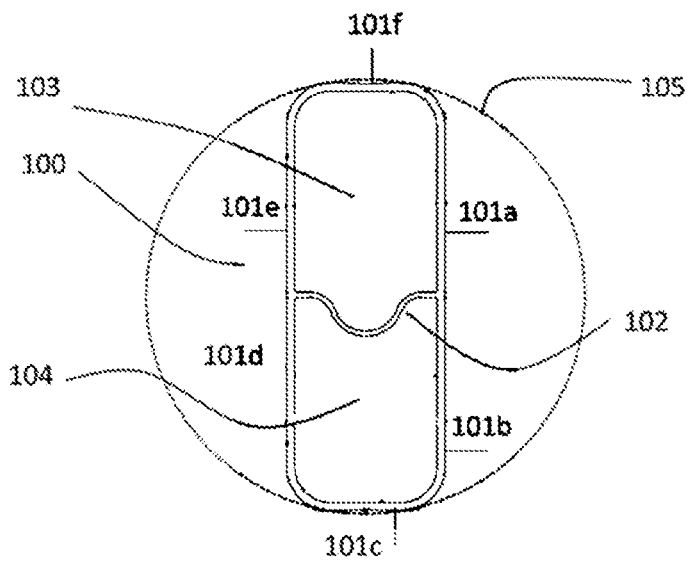
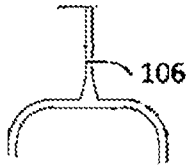
Fig 1A
FIG 2
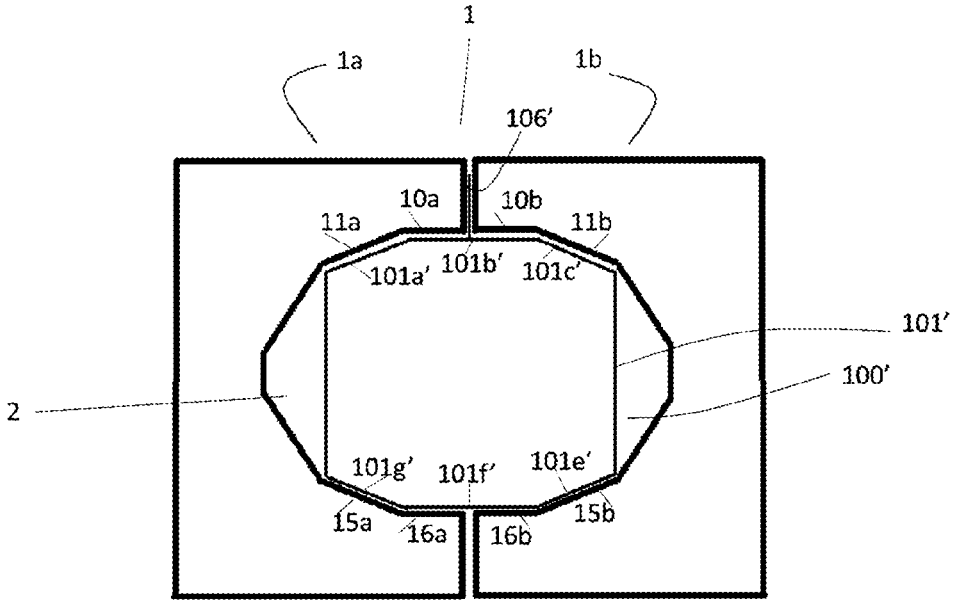

PRECISION FORMING OF METALLIC HOLLOW EXTRUSIONS

BACKGROUND OF THE INVENTION

Field of the Invention

The present invention relates on a method of forming hollow profiles to achieve large deformations, with a strict tolerance control without the need of hydroforming method. Specifically, the invention concerns an economical method of forming metallic hollow profiles for automotive applications, enabling variable cross sections along the length of the profile. It is applicable to hollow sections with multi chambers. The process achieves high-dimensional tolerance.

Description of the Related Art

Hollow profiles are often used as precursors for automotive applications, in particular for cross beam, crashbox, longitudinal member, door reinforcement, engine carrier applications. Hollow profiles precursor present a uniform cross-section in the length of the profile, with single or multi chambers cross sections. In automotive applications, shape requirements are often very challenging to achieve the desired fit and function characteristics. Consequently, many forming steps are imposed to hollow profiles in order to obtain the final structural parts.

Forming hollow profiles often requires expensive and careful forming steps to avoid the buckling and/or cracking of the hollow section with the outside action of a forming force.

It is recognized that many of these problems come from a lack of support in the interior of the hollow section. Therefore, some methods rely on a fixed insert in the hollow section at a suitable location, which supports the hollow profile during the forming operation. This method mitigates the risk of damaging the hollow profile by local buckling or cracking. The fixed insert must often stay in the shaped hollow section as it is difficult to remove it because of the deformation. It is desirable to avoid using such inserts as they increase the weight of the hollow section and generally do not contribute to stiffness.

The patent application EP2355942A1 discloses a method for forming hollow profiles, with at least one opening, wherein a rigid insert is placed in the hollow profile and the hollow profile acted upon externally by a forming device with at least one forming force to achieve a hollow profile end form. The aim of the invention is to at least partly avoid the disadvantages of conventional techniques for forming hollow profiles and in particular, to describe a method permitting forming of hollow profiles with high form accuracy in particular without the need for the insert to remain within the formed hollow profile. Said aim is achieved, wherein the insert after and/or on achieving the end form of the hollow profile is at least partly converted into a liquid and/or gaseous state and essentially completely removed from the hollow profile.

The patent application US 20090305797 A1 discloses a method of forming hollow profiles. A hollow profile is guided through a die in a processing direction and fixed by a mandrel such that at the die, the hollow profile has a material flow velocity in the processing direction in which the method the mandrel has a drawing velocity in the processing direction that is greater than the material flow velocity.

From the state of the art, the use of the Interior high pressure shaping, also known as hydroforming is well-known for forming hollow extrusion. The hollow section is filled with a liquid medium and the medium is set under high pressure, which presses the wall of the hollow section outward into the holders of the shaping device. It allows complex shapes. It is well suited to tubes or hollow profiles. The patent application EP2272601A1 describes a method which involves immersing a hollow profile into an immersion container filled with hydraulic fluid, and arranging the hollow profile filled with the fluid in a standard cavity of a molding press using an upper die and a lower die. Ends of the hollow profile are guided over sealing spikes during application of inner pressure of the press, and a fluid cushion provided between the cavity and the hollow profile is controllably maintained over a time period till guiding of the ends of the hollow profile over the sealing spikes is completed during discharging of the fluid. The patent U.S. Pat. No. 5,557,961 describes a method for hydroforming a tubular structural member of generally polygonal, flat walled cross section in which the various walls in the final part do not have the same thickness. A cylindrical tubular blank is extruded in which the outer surface is round, but in which the inner surface is asymmetrical, providing several contiguous angular sectors or portions of varying width and thickness. Each individual angular portion is tailored as to thickness and width to correspond to a respective wall in the final part. The blank is oriented between in a die cavity so as to align each angular portion with a respective wall of the finished part, and hydroformed in conventional fashion. Many applications of hydroforming can be found in the automotive industries: exhaust parts, camshafts, radiator frames, front and rear axles, engine cradles, crankshafts, seat frames, body parts, safety components, space frame.

According to the general book "Hydroforming for advanced manufacturing" published by Woodhead publishing in materials, hydroforming offers several advantages as compared to conventional manufacturing. These advantages include mainly weight reduction through more efficient section design and tailoring of the wall thickness, and tight dimensional tolerances and low spring back. The main drawbacks concern slow cycle time and expensive equipment. It exists also some limitation of the hydroforming process with respect to multi chambers hollow profiles. They are not easily hydroformed due to the difficulty to maintain a balanced fluid pressure between the different chambers.

SUMMARY OF THE INVENTION

The need for complex hollow members in a motor vehicle stems from the need to optimize the weight, stiffness, and strength requirement within the available packaging space in a car structure. This often results in components with variable cross sections, and with local depressions or protuberances. The final shape obtained through the forming operation must guarantee a high dimensional shape and straightness control. The challenge for industry is to develop economical solutions to fit with these expectations.

The invention is a low cost solution for forming hollow profiles with at least one chamber and enable variable cross sections along the longitudinal direction, with high dimensional control. It is an alternative to Interior High Pressure Shaping or hydroforming which is recognized as an efficient way for forming but requiring expensive equipment and long production cycle times as well as complex to implement on multi-chambers hollow profiles.

Another object of the invention is a method using inserts which can be removable after the end of the forming sequence.

Yet another object of the invention is the product obtained by the method of the invention. More specifically, products with variable cross sections, that can be preferably used for automotive applications, such as engine carrier, bumper cross beam, longitudinal member, pillar, door reinforcement and other axial crush members.

BRIEF DESCRIPTION OF THE DRAWINGS

The invention will be better understood and objects other than those set forth above will become apparent when consideration is given to the following detailed description thereof.

Such description makes reference to the annexed drawings wherein:

FIG. 1 is a cross-section of a precursor metallic hollow profile.

FIG. 1A is a partial cross-section of the precursor metallic hollow profile showing the optional flange.

FIG. 2 is a cross-section of a split die and a precursor metallic hollow profile positioned into a split die cavity.

DETAILED DESCRIPTION OF THE INVENTION

Figure 3:
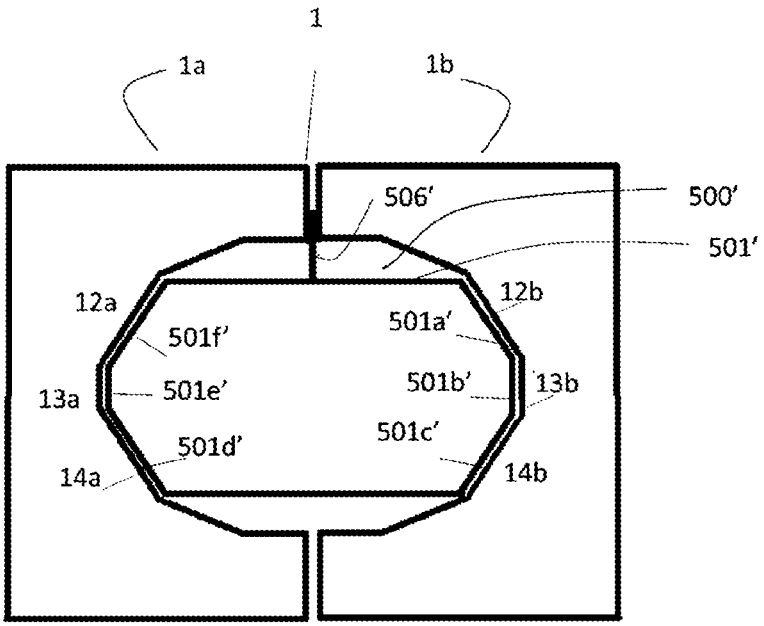
FIG. 3 is a cross-section of the split die and a high precision metallic component.

Referring more particularly now to the drawings:

FIG. 1 is a cross-section of a precursor metallic hollow profile (100) which has a constant section throughout its length. Element 105, drawn on FIG. 1 represents the circle in which the section of the precursor can be inscribed. FIG. 1 represents a cross section of a hollow extrusion with two precursor chambers (103 and 104). The shape of the extrusion is polygonal. It is constituted of externals wall such as 101*a*, 101*b*, 101*c*, 101*d*, 101*e*, 101*f* walls and internal wall (102). 101*a*, 101*b*, 101*c*, 101*d*, 101*e*, 101*f* elements correspond to different linear portions of the polygonal shape. In an alternative embodiment (FIG. 1A), a flange 106 is present to position the precursor in the split die cavity (not shown).

FIG. 2 is a cross-section of a split die 1 and a precursor metallic hollow profile 100' positioned into a split die cavity 2. The split die 1 is constituted of two metal halves (1*a* and 1*b*); each having a recess formed into the surface thereof. The two recesses form the split die cavity 2 which is polygonal; walls 101*a*', 101*c*', 101*g*' and 101*e*' of the precursor have respectively essentially the dimensions of walls 11*a*, 11*b*, 15*a*, 15*b* of the split die cavity 2. Walls 101*b*' and 101*f*' have respectively essentially the dimension of the sum of the dimension of walls 10*a* and 10*b* and, 16*a* and 16*b*.

The precursor 100' is positioned in the split die cavity 2 also with the positioning of an optional flange 106' between the two metal halves 1*a* and 1*b* of the split die 1.

FIG. 3 is a cross-section of the split die 1 and a high precision metallic component 500' with external walls 501' and an optional flange 506'. The recesses shapes of the two metal halves 1*a* and 1*b* are designed according to the shape of the high precision metallic component to be obtained.

12*a*, 13*a*, 14*a*, 12*b*, 13*b* and 14*b* walls of the split die cavity 2 have essentially the dimensions of the corresponding walls of the high precision metallic component; i.e. 12*a* wall of split die cavity 2 have the dimension of 501*f*' wall of the high precision metallic component with which it is in contact during the forming process; same for 13*a* wall with 501*e*' wall, 14*a* wall with 501*d*' wall, 12*b* wall with 501*a*' wall, 13*b* wall with 501*b*' wall and 14*b* wall with 501*c*' wall.

Figure 4:
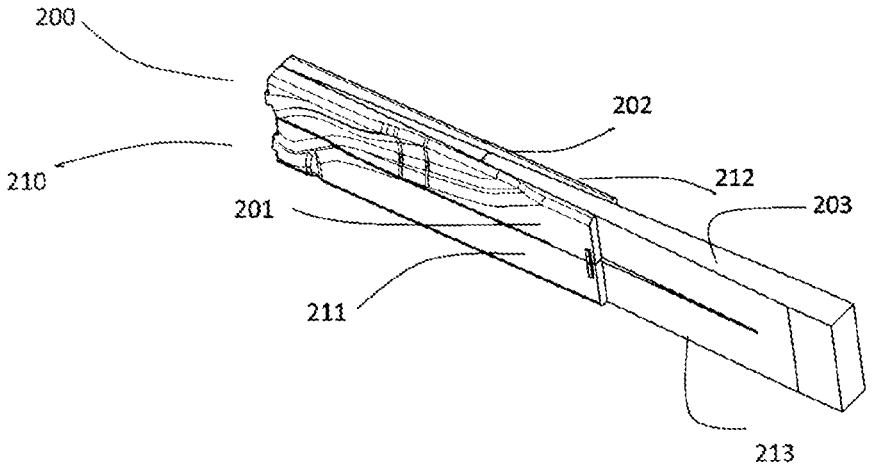
FIG. 4 is a perspective view of two mandrels.

FIG. 4 represents a perspective view of two mandrels (200 and 210). Upper mandrel 200 is constituted of 3 parts 201, 202 and 203. Parts 201 and 202 corresponds to the part designed to obtain the finished chamber dimension of the high-precision hollow metallic component. Parts 201 and 202 are tapered. Part 203 has a smooth surface and is tapered in the opposite direction. Part 203 can be inserted in between parts 201 and 202. Similarly lower mandrel 210 is constituted of 3 parts 211, 212 and 213.

Figure 5:
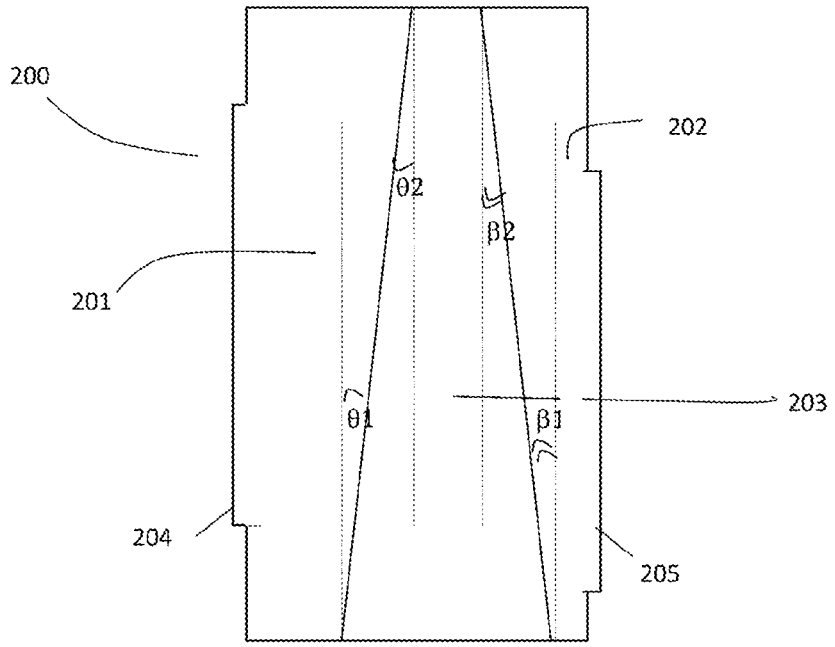
FIG. 5 is a schematic top view of FIG. 4.

FIG. 5 represents a schematic top view of FIG. 4 showing an embodiment of how the different parts of the mandrel can be designed. As it is shown the three parts 201, 202 and 203 of the mandrel are tapered. The taper angles of the part 203, θ2 and β2, are designed to facilitate its introduction between parts 201 and 202 which have respectively a taper angle θ1 and β1. On the outside surface of parts 201 and 202, a bump is present, corresponding to element 204 and 205. The part 203 has a smooth surface.

Figure 6:
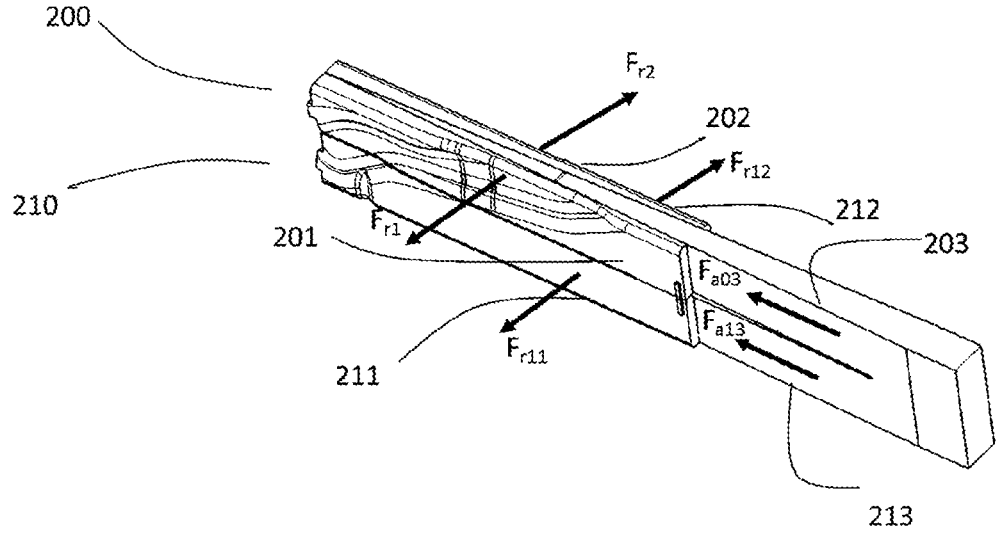
FIG. 6 shows the forces induced by the expansion of the mandrel.

The arrows $F_{r1}$, $F_{r2}$, $F_{r11}$, $F_{r12}$ on the FIG. 6 represents the forces induced by the expansion of the mandrel. To create these reactive forces, $F_{a03}$ and $F_{a13}$ forces are used to introduce parts 203 and 213 between parts 201 and 202 and, 211 and 212. The reactive forces $F_{r1}$, $F_{r2}$, $F_{r11}$, $F_{r12}$ applied respectively on parts 201, 202, 211 and 212 permit them moving outwardly, forcing the walls of the precursor hollow metallic profile 100 (not shown) to expand and conform between the mandrels and the split die walls (not shown).

Figure 7:
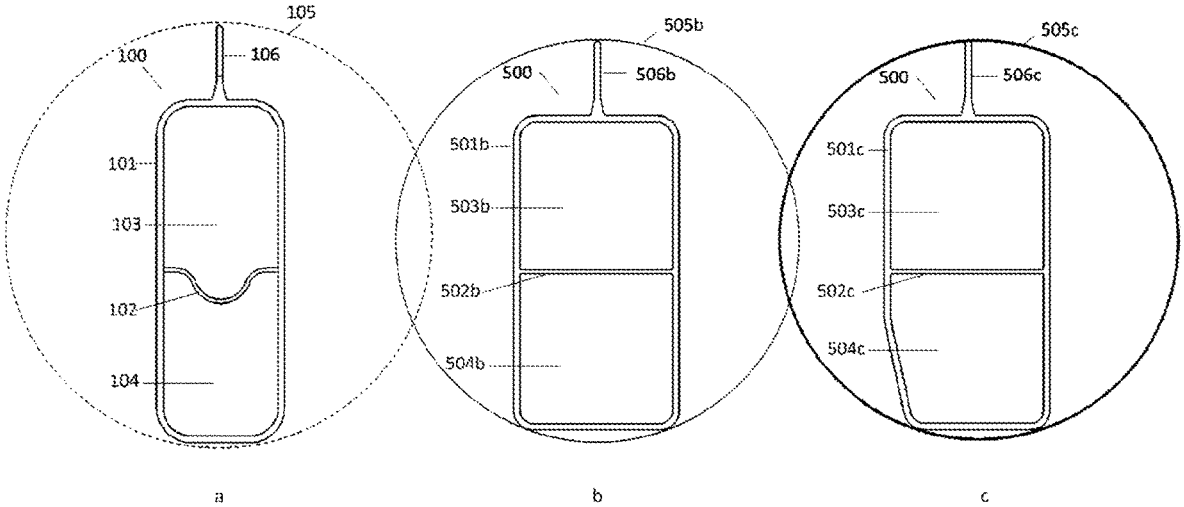
FIG. 7 shows the cross sections of the precursor hollow metallic profile (view a) and the high-precision hollow metallic component (views b and c).

FIG. 7 represents on view a, the cross section of the precursor hollow metallic profile 100*a* and on views b and c, the cross section of the high-precision hollow metallic component 500 at two different positions in the length of said high precision hollow metallic component obtained by the invention method. Element 505*b* and 505*c* represent the circle in which the section of the high precision hollow metallic component 500 can be inscribed. They have a different circle diameter and differ also from 105. 500 has two finished chambers. Depending on the position in the length of the high precision hollow metallic component, the internal geometry of the finished chambers are different. 503*b* and 504*b* correspond to the finished chamber of view b and 503*c* and 504*c* correspond to the finished chamber of view c. External wall 501*b* and 501*c* and internal wall 502*b* or 502*c* of component 500 are represented; they have been plastically deformed by the invention. Internal wall 102 previously having a non-flat, wavy shape has been elongated and flattened by the invention. After the walls 101 have been deformed; significant plastic strains in the wall, for example 501*b* and 501*c*, can be measured along the component, essentially at every location of the cross section. Such plastic strains enable to achieve high dimensional control with minimum distortions.

The invention concerns a method for manufacturing high-precision hollow metallic components having at least one finished chamber. This method comprises the following steps:

- a precursor hollow metallic profile with constant cross section having at least one precursor chamber is obtained through extrusion or roll forming. The number of precursor chambers corresponds to the desired number of finished chambers. The cross section of said precursor is selected according to the final targeted shape of the desired high-precision hollow metallic component and to impose during the forming process, significant plastic strains over essentially the entire precursor walls. Preferably plastic strain is at least 1%. Said precursor presents a constant cross section along its length. Preferably, its cross section presents walls having different thicknesses.

Said precursor is then positioned in a split die cavity. The split die cavity is a container, preferably designed to be split to allow the introduction of the precursor and the removal of the high-precision metallic component. When closed, at least two walls of the split die cavity have the dimensions of the outside dimensions of the corresponding walls of said component. Cross-section of the split-die cavity can be variable in its length. The split die cavity is opened on at least one end to permit the introduction of at least a mandrel into the precursor chamber.

Said mandrel is introduced in a precursor chamber of the precursor.

The precursor hollow metallic profile is plastically deformed by expanding said mandrel to obtain the finished dimensions of said high-precision hollow metallic component. By expanding the mandrel, it forces the precursor hollow metallic profile to conform to mandrel shape. Preferentially, the precursor hollow metallic profile conforms also to at least two walls of the split die cavity.

The mandrel may be expanded by any appropriate means to induce a perpendicular movement of said mandrel with regards to the precursor profile direction. Preferentially, the mandrel is constituted of at least two parts and the expansion can be obtained by introducing between the two parts a third part or compressed air or any appropriate other fluid to induce a perpendicular movement of said two parts with regards to the precursor profile direction.

Said perpendicular movement creates a perpendicular force which is the origin of the plastic deformation of said precursor hollow metallic profile. The precursor hollow metallic profile being held into the split die cavity, additional forces can be created due to the interaction between the precursor hollow metallic profile and split die cavity walls.

In a preferred embodiment, said mandrel is at least constituted of three parts, wherein at least two of which have at least a wall with the same dimension as the corresponding wall of the finished chamber of the high precision hollow metallic component, at least one other part has a smooth surface and a tapered shape; preferentially the part with the smooth surface is inserted in between the two other parts.

If the precursor has more than one chamber, a mandrel is preferably inserted in each chamber.

Said mandrel is removed from said high-precision hollow metallic component by reversing the expanding action.

Finally said split-die is opened to remove said high-precision hollow metallic component.

By designing accordingly the shape of the split die cavity and the shape of the mandrel, it is possible to obtain a variable cross section throughout the length of the component. By variable cross section, it is understood that the cross-section is different along the length of the component, e.g. has depressions or protuberances at different portions along the length of the component and/or has at least a finished chamber with a varying shape along the length of the high precision hollow metallic component. Indeed, the exterior shape of the mandrel and the shape of the split die cavity can vary in the longitudinal direction. When the mandrel is expanded, it forces locally the precursor hollow metallic profile to conform to mandrel shape which varies along length of part and/or to at least two walls of the split die cavity. Consequently a variable cross section high-precision hollow metallic component can be obtained.

For consistent positioning of the precursor in the split die cavity, it is preferred according to the invention that the cavity has essentially at least two internal walls having the same dimensions as the corresponding precursor metallic profile walls.

The invention permits to obtain a high precision hollow metallic component. To achieve such high precision dimension, the shape of the precursor hollow metallic component is designed to impose during the forming process significant plastic strains over essentially the entire precursor walls. It is preferred that plastic strain is at least 1%.

Plastic strain induced by the process can be determined for example using finite element modeling (FEM) or direct measurement. FEM method is based on the simulation of the process, knowing in particular the mechanical property law of the metal constituting the precursor, its shape and the geometry of the high-precision hollow metallic component. Direct measurement is based on the measurement of the thickness of the high-precision hollow metallic component to that of the precursor part, using preferably ultrasonic thickness gauge.

The forming process, when the mandrel is expanding, is performed at a temperature comprised between room temperature and 300° C., preferably at room temperature.

Preferentially, the precursor has at least two chambers.

The high precision hollow metallic component can be optionally submitted to other steps of finishing, such as artificial aging or other thermal treatment, bending, welding, trimming, cutting, drilling, machining or fastener installation.

In a preferred embodiment, the precursor hollow metallic profile is made of metal included in the group consisting of aluminum alloys, steel, magnesium alloys or titanium alloys.

The invention enables manufacturing variable cross section hollow metallic components. It is particularly applicable for variable cross section hollow aluminum component with at least two chambers, in particular for automotive structures.

The process is applicable to produce structural components like engine carrier, axial crush member, pillar, cross beam, crash boxes, longitudinal member and door reinforcement components.

Metallic hollow profiles are often used as precursors to form high precision hollow metallic components.

Referring to FIG. 1, a precursor metallic hollow profile 100 presents a constant cross section in the longitudinal direction. In the embodiment of FIG. 1, it is formed of two chambers; one or more internal chambers are suitable in the method of the invention. The precursor 100 of FIG. 1 is obtained by extrusion. When said precursor is obtained through roll forming, welding step may be necessary to close the hollow profile. The precursor of FIG. 1 presents different wall thicknesses for the external wall 101 and the internal wall 102: thickness wall dimensions of said precursor are typically from 0.5 mm to 5 mm, more preferably from 0.8 mm to 3.5 mm, and more preferably from 1.5 to 3 mm. Said precursor is preferably cut to a given length, typically a length between 0.3 m to 2.5 m, more preferentially 0.5 to 2 m. and more preferentially 0.7 m to 1.0 m.

The shape of the precursor is selected according to the final geometry to be obtained, to ensure that sufficient plastic strains are achieved during the forming process.

The precursor hollow metallic profile is preferably constituted of metal included in the group of aluminum alloys, steel, magnesium alloys, titanium alloys. Among the aluminum alloys, 6XXX aluminum series are preferred and advantageously formed in T4 temper.

This precursor hollow metallic profile is positioned in a split die cavity.

The split die preferably consists of two metal halves (1*a* and 1*b* of FIG. 2 or FIG. 3), each having a recess formed into the surface thereof. The recesses are in the form of an elongated channel which may extend in the length of the half. When the halves are joined together, the recesses complement one another to form an elongated cavity (2). Said split die cavity (2) has preferentially a variable cross-section along its length. The cavity cross section may have a plurality of shape: circular, ovoid, or preferably polygonal shape. The split die cavity is constituted of walls which can be defined for instance by linear portions (for example see 10*a* to 16*a* and 10*b* to 16*b* walls on FIG. 2 and FIG. 3), by angular sections, or any other appropriate sections.

The split die cavity has at least two walls having essentially the dimensions of the corresponding walls of the high precision hollow metallic component. On FIG. 3, six walls 12*a*, 13*a*, 14*a*, 12*b*, 13*b*, 14*b* walls have respectively essentially the dimensions of 501*f*', 501*e*', 501*d*', 501*a*', 501*b*' and 501*c*' walls of the high precision hollow metallic component.

To ensure that the precursor is well positioned and maintained, optionally a flange element (for example see element 106 of FIG. 1 or 106' of FIG. 2) is positioned preferentially between the two metal halves of the split die.

A preferred embodiment for positioning the precursor consists in having at least two opposing walls of the cavity which have the dimensions of the precursor hollow profile.

The split die is preferably made of a suitable tool steel, such as D2, S2, or hardened SAE 4140.

A mandrel, such as mandrel 200 and 210 of FIG. 4 is then inserted in each chamber of the precursor hollow metallic profile, such as chambers 103 and 104 of FIG. 1.

The longitudinal direction of said mandrel is parallel to the extrusion direction if the profile is obtained by an extrusion method or to the longitudinal direction if the profile is obtained by roll forming.

The mandrel is designed in a way that at least a wall has the same dimension of the corresponding wall of the finished chamber of the high precision hollow metallic component. The mandrels are preferably made of a suitable tool steel, such as D2, or S2.

Mandrels are adapted to be inserted in the precursor chamber. For a same precursor, there can be specific mandrel geometries for each chamber. The length of the mandrel is of the same order of magnitude than the precursor profile length. To enable easy insertion, the mandrel can be somehow longer, preferentially 50 mm to 500 mm longer than the precursor.

Preferentially, the mandrel is constituted of at least two parts.

Each part is designed such as to have its longitudinal direction parallel to the longitudinal direction of said mandrel. Each part is designed in a way that at least a wall has the same dimension of the corresponding wall of the finished chamber of the high precision hollow metallic component, including the depressions, hollows, bumps (204 or 205) on the outside surface of the part as illustrated by FIG. 5. This part of the mandrel, for example part 202 of FIG. 4, can have a varying cross section all along its length.

In a preferred embodiment, the mandrel is constituted of at least three parts. At least two parts are designed in a way that at least a wall has essentially the dimension of the corresponding wall of the finished chamber of the high precision hollow metallic component and one part has a smooth surface on all its surface.

The parts are preferably tapered. The taper angles (θ2 and β2) of the part with the smooth surface are preferentially complementary with the adjacent taper angles (respectively θ1 and β1), e.g. referring to FIG. 5, angles θ1 and θ2 are preferentially equal and angles β1 and β2 are preferentially also equal.

Preferentially, the parts with a non-smooth surface, for example parts 201 and 202 illustrated by FIG. 5 are first inserted into the precursor chamber. A significant force must then be exerted to introduce the smooth part, as described by FIG. 6. This force is multiplied by the wedge ratio, resulting in the forming force required to displace the outer parts of the mandrel (201-202, and 211-212) outward, plastically deforming the precursor to the outside shape of the mandrel and the split-die cavity.

Due to the generalized plastic deformation along the length of the profile, at essentially every location of the cross section, it is possible to ensure particularly high tolerance requirements in terms of the dimensional accuracy.

The forming step of the invention, corresponding to the step during when the mandrel is expanding is in a preferred embodiment performed at a temperature below 300° C., more preferably at room temperature.

Said mandrel is then removed from said high-precision hollow metallic component by reversing the expanding action. In the embodiment of a mandrel with three parts, the smooth part is removed first to reverse the expanding action.

The split die is opened to permit the removal of the high precision hollow metallic component.

A high-precision hollow metallic component is thus obtained. Its shape and geometry is modified as referred for example to the circle 505*b* or 505*c* of FIG. 7 in which the section of the high precision hollow metallic component 500 can be inserted which is different from the circle 105 in which the section of the precursor 100 can be inserted. 500 has a variable cross section along its length as referred for example on the views of FIG. 7 *b* and *c*. 500 has two finished chambers whose geometries vary along the length as referred for example on 504*b* and 504*c* finished chamber. It presents along its length variable wall thickness induced by the plastic deformation.

The invention allows to obtain high precision hollow component with at least two finished chambers having a variable cross section. Obtaining said last component is difficult to achieve using an hydroforming process due the complexity resulting from having to equilibrate the pressure in each chamber.

The high precision hollow metallic component can be submitted to subsequent other forming steps, such as bending, welding, trimming, cutting, drilling, machining or fastening to obtain structural components. These steps are chosen and implemented according to the specifications of the structural components to be obtained. Each step can be used solely or implemented as sequences of different steps in any order.

The invention is also advantageous to remove the inherent twist induced by the extrusion process on the precursor hollow profile.

The invention allows manufacturing of very precise depressions, such as about 1 mm deep depression, without any issue associated to springback.

The invention allows for such depressions to be created without adding any unwanted folding of additional materials. With the method of the invention detrimental effects of additional materials on crash results and/or interference of such materials with other surrounding parts are avoided. For axial crush members, after the precision forming process according to the invention, the piece maintains the excellent folding characteristics when crushed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A method for manufacturing a high-precision hollow metallic component having at least two finished chambers, the method comprising:

providing a precursor hollow metallic profile having a constant cross section, external walls, and at least two precursor chambers;

positioning the precursor hollow metallic profile in a split-die cavity, wherein at least two internal walls of the split die cavity have essentially outside dimensions of corresponding walls of the high-precision hollow metallic component;

introducing a mandrel into a first precursor chamber of the at least two precursor chambers;

plastically deforming the precursor hollow metallic profile by expanding the mandrel in the first precursor chamber;

reversing the expanding action of the mandrel in the first precursor chamber;

removing the mandrel from the first precursor chamber;

introducing the mandrel into a second precursor chamber of the at least two precursor chambers;

plastically deforming the precursor hollow metallic profile by expanding the mandrel in the second precursor chamber;

reversing the expanding action of the mandrel in the second precursor chamber;

removing the mandrel from the second precursor chamber; and opening the split-die, and removing the high-precision hollow metallic component.

2. The method according to claim 1, wherein a shape of the mandrel and a shape of the split die cavity varies in a longitudinal direction thereof, and wherein a variable cross section along a length of the high precision hollow metallic component is obtained by expanding the mandrel to force the precursor hollow metallic profile to conform to the shape of the mandrel.

3. The method according to claim 2, wherein the shape of the split die cavity varies with respect to at least two walls of the split die cavity.

4. The method according to claim 1, wherein said mandrel expansion induces a perpendicular movement of said mandrel relative to a direction of the precursor hollow metallic profile.

5. The method according to claim 1, wherein said mandrel comprises two parts, wherein said mandrel expansion is obtained by introducing an element between said two parts to induce a perpendicular movement of said mandrel relative to a direction of the precursor hollow metallic profile.

6. The method according to claim 1, wherein said mandrel comprises three parts, wherein two of said three parts have a wall with the same dimension as the corresponding wall of the finished chamber of the high-precision hollow metallic component, and wherein one of said three parts has a smooth surface and a tapered shape.

7. The method according to claim 1, wherein said precursor hollow metallic component has a shape designed to impose, during the plastic deforming of said precursor hollow metallic profile by expanding said mandrel, significant plastic strains of at least 1%, over the external walls of the precursor hollow metallic profile.

8. The method according to claim 1, wherein at least two internal walls of said split die cavity have the same dimensions as at least two of the external walls of the precursor hollow metallic profile.

9. The method according to claim 1, wherein said precursor hollow metallic profile is made of a metal selected from the group consisting of aluminum alloys, steel, magnesium alloys, and titanium alloys.

10. The method according to claim 1, wherein the plastic deforming of said precursor hollow metallic profile by expanding said mandrel is carried out at a temperature between room temperature and 300° C.

11. The method according to claim 10, wherein the plastic deforming is carried out at room temperature.

12. The method according to claim 1, wherein the high-precision hollow metallic component is further processed by thermal treatment, bending, welding, trimming, cutting, drilling, machining, or fastening.

13. A method for manufacturing a high-precision hollow metallic component having at least two finished chambers, the method comprising:

providing a precursor hollow metallic profile having a constant cross section, external walls, and at least two precursor chambers;

positioning the precursor hollow metallic profile in a split-die cavity, wherein at least two internal walls of the split die cavity have essentially outside dimensions of corresponding walls of the high-precision hollow metallic component;

introducing a first mandrel into a first precursor chamber of the at least two precursor chambers;

plastically deforming the precursor hollow metallic profile by expanding the first mandrel in the first precursor chamber;

reversing the expanding action of the first mandrel in the first precursor chamber;

removing the first mandrel from the first precursor chamber;

introducing a second mandrel into a second precursor chamber of the at least two precursor chambers;

plastically deforming the precursor hollow metallic profile by expanding the second mandrel in the second precursor chamber;

reversing the expanding action of the second mandrel in the second precursor chamber;

removing the second mandrel from the second precursor chamber; and opening the split-die, and removing the high-precision hollow metallic component.

14. The method according to claim 13, wherein the first mandrel and the second mandrel have a same or different geometry.

15. The method according to claim 14, wherein, after the expanding action of the first mandrel and the second mandrel, the first precursor chamber has a same or different geometry than the second precursor chamber.

16. The method according to claim 13, wherein the plastic deforming of said precursor hollow metallic profile is carried out at a temperature between room temperature and 300° C.

17. The method according to claim 16, wherein the plastic deforming is carried out at room temperature.

18. The method according to claim 13, wherein the high-precision hollow metallic component is further processed by thermal treatment, bending, welding, trimming, cutting, drilling, machining, or fastening.

* * * * *